US005123351A

United States Patent [19]

Guaraldi et al.

[11] Patent Number: 5,123,351

[45] Date of Patent: Jun. 23, 1992

[54] SPEED MATCH DUCTOR ASSEMBLY

[75] Inventors: Glenn A. Guaraldi, Kingston; David G. Addison, Dover; David C. Gibson, Barrington, all of N.H.

[73] Assignee: Heidelberg Harris GmbH, Dover, N.H.

[21] Appl. No.: 582,560

[22] Filed: Sep. 14, 1990

[51] Int. Cl.[5] ..... B41F 31/14; B41F 31/34; B41L 27/34

[52] U.S. Cl. ..... 101/350; 101/DIG. 32

[58] Field of Search ..... 101/349, 348, 350, 207, 101/208-210, 148, DIG. 32, 340, 342, 344, 346, 351, 352, 356, 357, 358, 360, 361

[56] References Cited

U.S. PATENT DOCUMENTS

| | | | |
|---|---|---|---|
| Re. 20,458 | 7/1937 | Schlesinger | 101/350 |
| 701,119 | 5/1902 | Wood | 101/350 |
| 1,450,270 | 4/1923 | Walser et al. | 101/350 |

*Primary Examiner*—J. Reed Fisher
*Attorney, Agent, or Firm*—Tarolli, Sundheim & Covell

[57] ABSTRACT

In a printing press, a ductor assembly for transferring ink from a slowly rotating fountain roll to a rapidly rotating ink receiving roll includes a carriage and first and second idler rolls supported in counterrotating engagement on the carriage. In one embodiment, the ductor assembly moves between a first position in which the first idler roll contacts and picks up ink from the fountain roll, and a second position in which the second idler roll contacts and transfers ink to the ink receiving roll. The ductor assembly is driven to rotate at a speed intermediate the speeds of the fountain roll and the ink receiving roll, in a direction the same as the direction of rotation of the second idler roll about its own axis, and opposite to the direction of rotation of the first idler roll about its axis. When the ductor assembly moves to the second position, the surface of the second idler roll which contacts the ink receiving roll is moving in the same direction as the surface of the ink receiving roll, and is moving with a speed about equal to the speed of the ink receiving roll. This minimizes speed mismatch. In another embodiment, the rotating ductor assembly is fixed in position and the ink receiving roll moves into and out of contact with the ductor assembly.

11 Claims, 8 Drawing Sheets

SPEED MATCH DUCTOR ASSEMBLY

BACKGROUND OF THE INVENTION

1. Technical Field

This invention relates to apparatus for transferring ink from one roll to another roll in a printing press. More particularly, this invention relates to a ductor assembly for transferring ink between a fountain roll and an ink receiving roll which are rotating at different surface speeds.

2. Prior Art

A known printing press has a fountain roll (ink supply roll), and an ink receiving roll. A moving ductor roll contacts the fountain roll, and ink is transferred from the fountain roll to the ductor roll. The ductor roll then moves to the ink receiving roll. The ductor roll contacts the ink receiving roll, and ink is transferred from the ductor roll to the ink receiving roll. The ink receiving roll transfers the ink through an ink train to a roll which applies the ink to the material being printed.

Typically the fountain roll rotates relatively slowly, and the ink receiving roll rotates much more rapidly. The ductor roll is rotating relatively slowly when it contacts the rapidly rotating ink receiving roll. The mismatch in speeds between the ductor roll and the ink receiving roll causes a shock which travels through the ink train. This shock can cause printing errors. The mismatch in speeds also adversely affects ink transfer and ink control.

SUMMARY OF THE INVENTION

In accordance with the present invention, a ductor assembly for transferring ink from a fountain roll to an ink receiving roll includes a carriage and first and second rolls supported for rotation by the carriage. The first and second rolls are at least at times in driving engagement with each other.

In one embodiment of the invention, the ductor assembly moves between a first position in which the ductor assembly contacts the fountain roll, and a second position in which the ductor assembly contacts the ink receiving roll. The ductor assembly is rotatable at a speed intermediate the speed of the fountain roll and the speed of the ink receiving roll. When the ductor assembly moves to the first position, the first idler roll contacts the fountain roll and picks up ink from the fountain roll. This contact starts the first idler roll rotating about its own axis. As the first idler roll rotates, it starts the second idler roll rotating about its own axis and ink is transferred to the second idler roll. The ductor assembly then moves to the second position. The second idler roll contacts the ink receiving roll and transfers ink to the ink receiving roll. The ductor assembly is preferably rotated at a speed and in a direction of rotation to cause the surface of the second idler roll to move at a speed about equal to the speed of the ink receiving roll. Thus, speed mismatch is minimized.

In a second embodiment of the invention, the rotating ductor assembly is fixed in position relative to the fountain roll. The ink receiving roll moves into and out of contact with the rotating ductor assembly. The ductor assembly includes a first roll which is small in diameter, and a second roll which is large in diameter. The larger diameter roll contacts the fountain roll once during each rotation of the ductor assembly. Ink is transferred from the larger roll to the smaller roll. The ink receiving roll moves into contact with the smaller diameter roll, and ink is transferred to the ink receiving roll.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENTS

Figure 1:
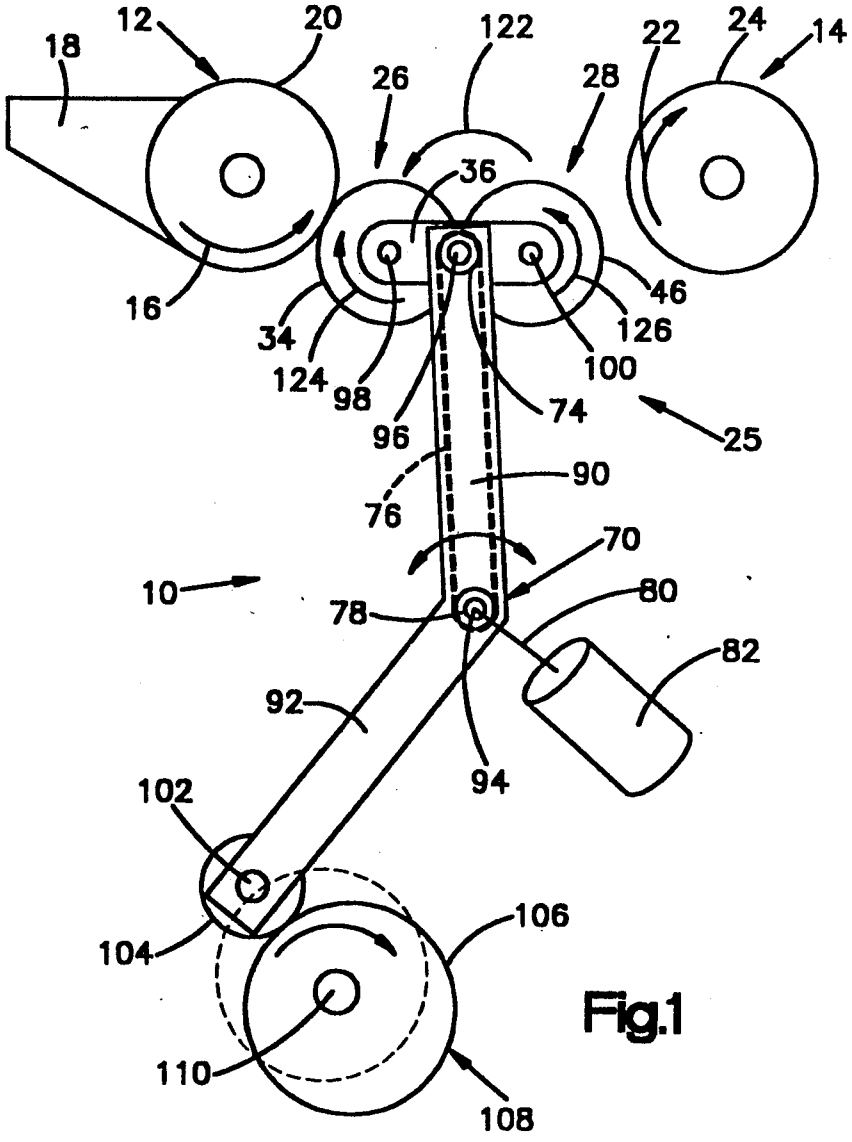
FIG. 1 is a schematic illustration of a portion of a printing press including a ductor assembly in accordance with the present invention, the ductor assembly being in contact with an ink supply roll.

FIG. 1 illustrates schematically an apparatus 10 for transferring ink between a fountain roll 12 and an ink receiving roll 14 in a rotary printing press. The fountain roll 12 rotates in a direction indicated by the arrow 16 relative to an ink fountain 18. As the fountain roll 12 rotates, the outer surface 20 of the fountain roll 12 picks up ink from the ink fountain 18. The fountain roll 12 rotates relatively slowly, with its outer surface 20 moving at a speed of, for example, less than ten feet per minute.

The ink receiving roll 14 rotates in a direction indicated by the arrow 22. The ink receiving roll 14 receives ink and transfers that ink, through an ink train (not shown) which includes other rolls, to material being printed in the press, in a known manner. The ink receiving roll 14 rotates relatively rapidly, with its outer surface 24 moving at a surface speed of, for example, about 3,000 feet per minute.

Ink is transferred from the fountain roll 12 to the ink receiving roll 14 by a ductor assembly 25. The ductor assembly 25 includes a pair of idler rolls 26 and 28 and a carriage 36. The first idler roll 26 contacts the fountain roll 12 and picks up ink from the fountain roll 12 (FIG. 1). The first idler roll 26 drivingly engages the second idler roll 28 to transfer ink to the second idler roll 28. The second idler roll 28 contacts the surface 24 of the ink receiving roll 14 (FIG. 4) to transfer ink to the ink receiving roll 14.

Figure 5:
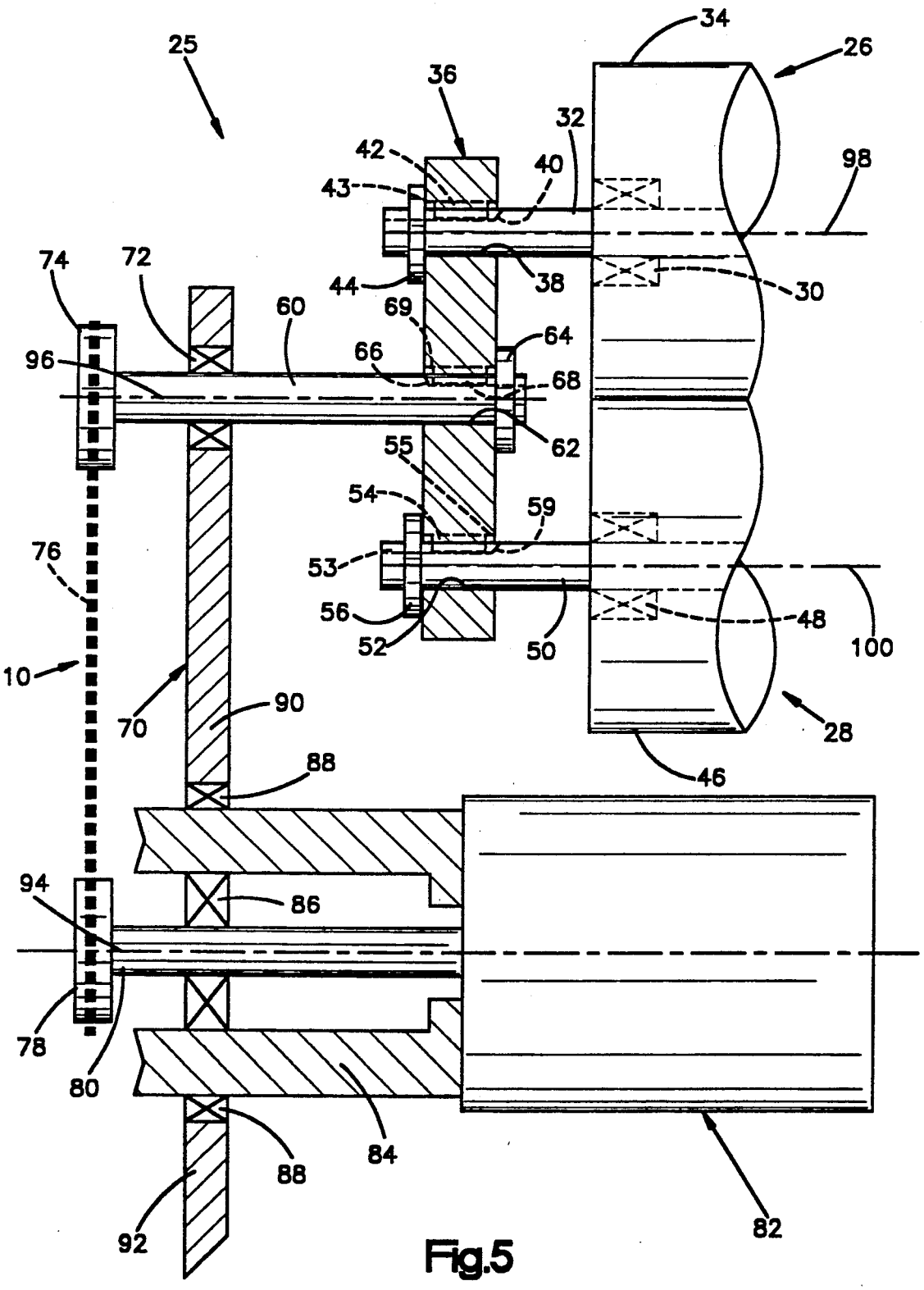
FIG. 5 is a view, partly in section, showing one axial end of the ductor assembly.
Figure 6:
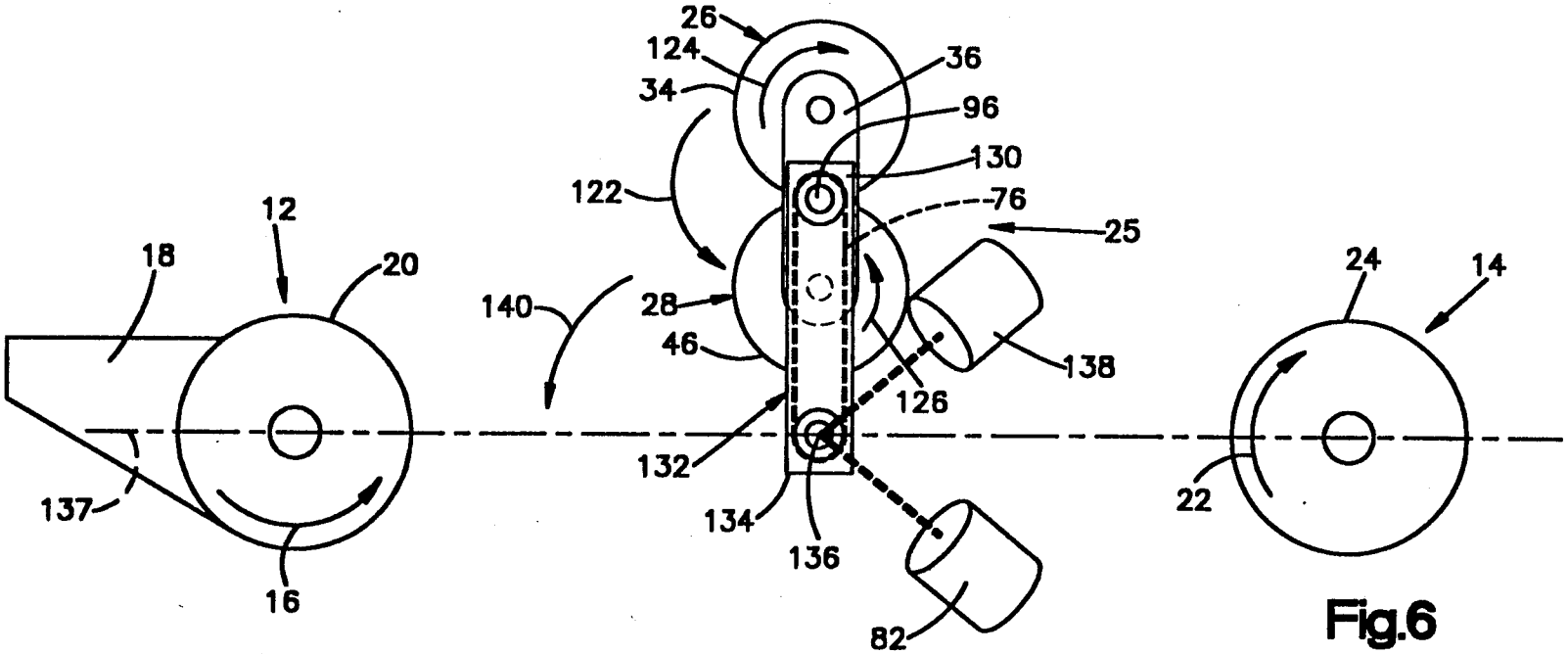
FIG. 6 is a schematic illustration of a portion of a printing press in accordance with a second embodiment of the present, invention.

The first idler roll 26 is journalled on a bearing 30 (FIG. 5) for rotation about a shaft 32. The shaft 32 extends through an opening 38 in the carriage 36. An axially extending keyway 40 in the shaft 32 receives a key 42. The key 42 is retained in a keyway 43 in the surface of the opening 38 in the carriage 36. The key 42 blocks rotation of the shaft 32 relative to the carriage 36. The shaft 32 is retained axially relative to the carriage 36 by a collar 44.

The second idler roll 28 is journalled on a bearing 48 for rotation about a shaft 50. The shaft 50 extends through an opening 52 in the carriage 36. An axially extending keyway 53 in the shaft 50 receives a key 54. The key 54 is retained in a keyway 59 in the surface of the opening 52 in the carriage 36. The key 54 blocks rotation of the shaft 50 relative to the carriage 36. The shaft 50 is retained axially relative to the carriage 36 by a collar 56.

A shaft 60 extends parallel to the shafts 32 and 50 and supports the carriage 36 for rotation. The shaft 60 extends through an opening 62 in the carriage 36. An axially extending keyway 66 in the shaft 60 receives a key 68. The key 68 is retained in a keyway 69 in the surface of the opening 62 in the carriage 36. The key 68 blocks rotation of the carriage 36 relative to the shaft 60. A collar 64 blocks axial movement of the shaft 60 relative to the carriage 60.

A driven sprocket 74 is fixed on the end of the shaft 60. The driven sprocket 74 receives a drive belt 76. The drive belt 76 extends around a drive sprocket 78 on the end of an output shaft 80 of an electric motor 82. The electric motor 82 is fixed on a stationary frame member 84 of the printing press. The output shaft 80 of the electric motor 82 rotates in a bearing 86 in the frame member 84.

The shaft 60 which supports the carriage 36 is journalled for rotation in a pivot arm 70 by a bearing 72. The pivot arm 70 is journalled for rotation about a bearing 88 on the frame member 84. The pivot arm 70 includes a first arm portion 90 (FIG. 1) and a second arm portion 92 fixed at an angle to the first arm portion 90. The pivot arm 70 pivots about a pivot axis 94 (FIG. 5) which is coaxial with the bearing 88 and the output shaft 80 of the motor 82. The ductor assembly 25 rotates about an axis of rotation 96 which is parallel to the pivot axis 94. The axis of rotation 96 is parallel to and lies in a plane containing the central axes of rotation 98 and 100 of the first and second idler rolls 26 and 28, respectively.

The second arm portion 92 (FIG. 1) of the pivot arm 70 extends outwardly from the pivot axis 94 and has near its outboard end a shaft 102 on which a cam follower 104 rotates. The cam follower 104 rides on an outer surface 106 of a cam 108. The cam 108 is driven to rotate about an axis 110, preferably at half the speed of the motor shaft 80.

The opposite axial end of the ductor assembly 25, which is not shown in the drawings, is similar to the end shown in the drawings, with the basic exception that in the preferred embodiment it does not have a second drive mechanism for rotating the ductor assembly 25 about its axis 96. Thus, the opposite axial ends of the first and second idler rolls 26 and 28 are supported for rotation in another carriage similar to the carriage 36. The other carriage is supported for rotation in another pivot arm similar to the pivot arm 70. The other pivot arm is caused to pivot simultaneously as a unit with the pivot arm 70 by a cam mechanism which is similar to or a part of the cam mechanism shown in the drawings. If desired, a second drive mechanism for the opposite axial end of the ductor assembly could be provided.

The cam mechanism moves the ductor assembly 25 between a first position (FIG. 1) in which the first idler roll 26 contacts the fountain roll 12 and a second position (FIG. 4) in which the second idler roll 28 contacts the ink receiving roll 14. As the cam 108 rotates about its eccentric axis of rotation 110, the cam follower 104 moves toward and away from the cam axis 110. As the cam follower 104 moves, the end of the pivot arm portion 92 moves, pivoting the entire pivot arm 70 about the pivot axis 94. This pivotal movement of the pivot arm 70 moves the ductor assembly 25 between the first and second positions.

When the motor 82 is energized, the output shaft 80 rotates the drive sprocket 78 and thus the driven sprocket 74 through the drive belt 76. The driven sprocket 74 rotates the shaft 60. The shaft 60 rotates the carriage 36 and the idler rolls 26 and 28, which together constitute the ductor assembly 25. Thus, the ductor assembly 25 is continuously driven to rotate about the axis of rotation 96 of the carriage 36 while the ductor assembly 25 moves between its first and second positions.

The ductor assembly 25 is rotated in a direction indicated by the arrow 122 (FIG. 1). The ductor assembly 25 is rotated at a speed which is intermediate the slower surface speed of the fountain roll 12 and the faster surface speed of the ink receiving roll 14. The rotation of the ductor assembly 25 about its axis of rotation 96 imparts to the surfaces of the idler rolls 26 and 28 a surface speed component which is intermediate the first and second surface speeds.

The rotation of the ductor assembly 25 about its axis of rotation 96 is timed relative to the pivotal movement of the pivot arm 70. The rotation of the ductor assembly 25 is timed so that when the ductor assembly is moved to the position shown in FIG. 1, the first idler roll 26 contacts the surface 20 of the fountain roll 12, and when the ductor assembly 25 is moved to the position shown in FIG. 4, the second idler roll 28 contacts the surface 24 of the ink receiving roll 14. Thus, the first idler roll 26 is the idler roll which contacts the fountain roll 12, and the second idler roll 28 is the idler roll which contacts the ink receiving roll 14.

Figure 2:
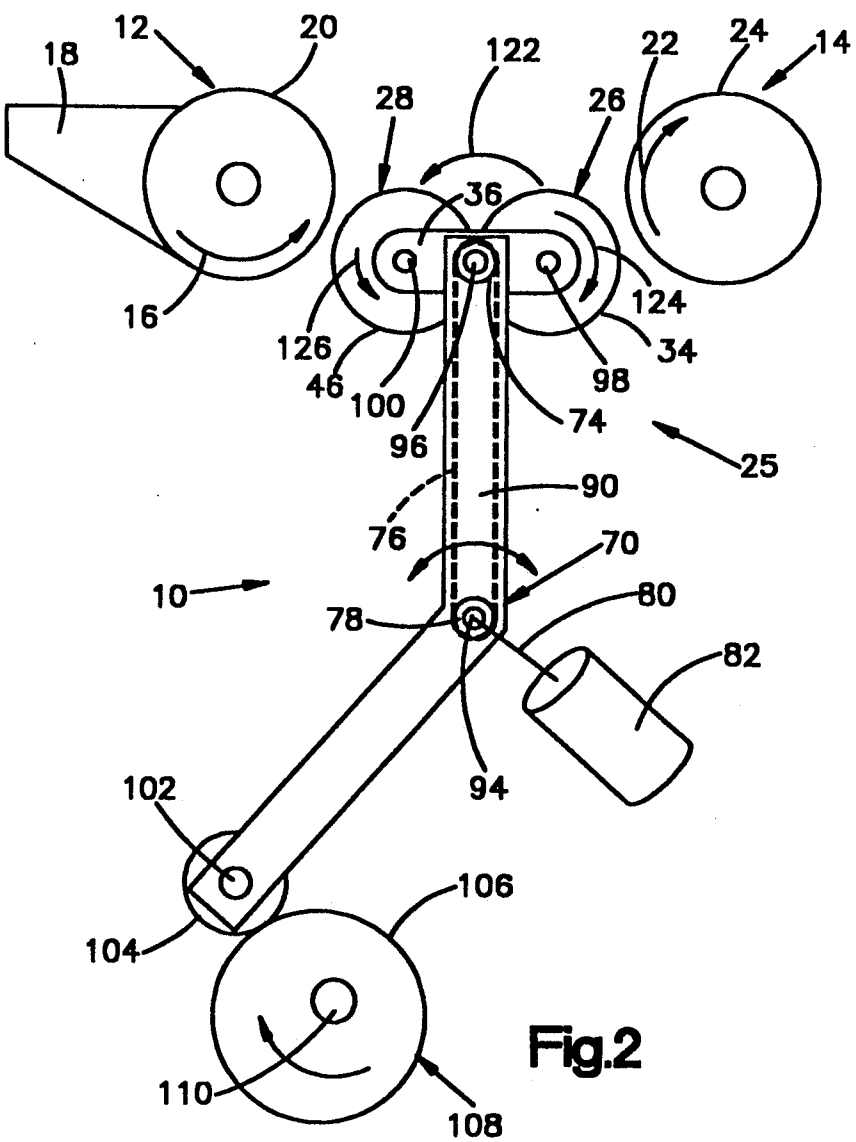
FIG. 2 is a schematic illustration similar to FIG. 1 with the ductor assembly spaced from both the ink supply roll and the ink receiving roll.
Figure 3:
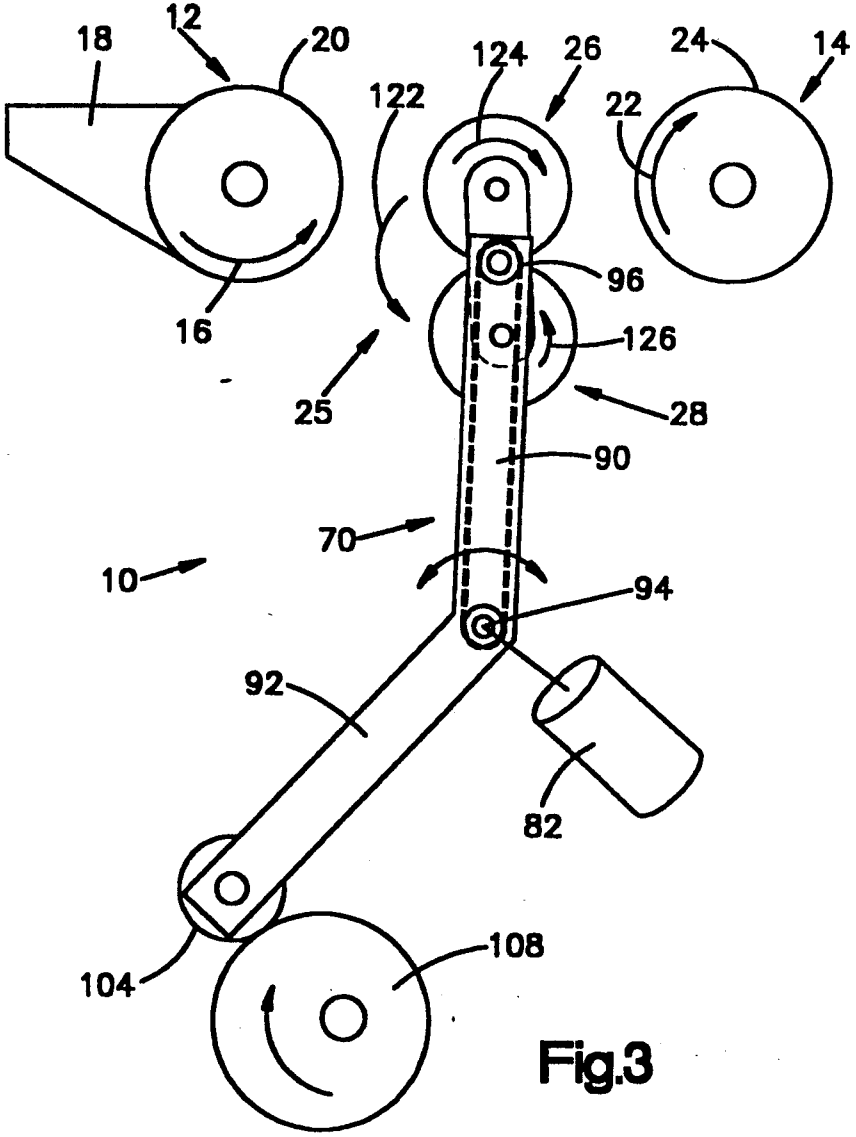
FIG. 3 is a schematic illustration similar to FIG. 2 with parts of the ductor assembly in a different orientation.

When the printing press is started, the fountain roll 12 rotates slowly and the ink receiving roll 14 rotates rapidly. The ductor assembly 25 is stationary in a position as shown in FIGS. 2 or 3, that is, spaced apart from both the fountain roll 12 and the ink receiving roll 14 and not moving between them. The idler rolls 26 and 28 are not rotating about their respective axes of rotation 98 and 100.

While the ductor assembly 25 is stationary, the motor 82 is energized. The motor 82 through the belt 76 drives the ductor assembly 25 to rotate about its axis of rotation 96. The ductor assembly 25 rotates in the direction shown by the arrow 122, that is, opposite to the direction of rotation 22 of the ink receiving roll 14.

The cam 108 is then driven to rotate, and through the cam follower 104 causes the pivot arm 70 to pivot about the pivot axis 94. This pivotal movement of the pivot arm 70 moves the ductor assembly 25 between the fountain roll 12 and the ink receiving roll 14.

The rotating ductor assembly 25 is first moved from the intermediate position of FIGS. 2 or 3 to the position shown in FIG. 1 to contact and pick up ink from the fountain roll 12. The first idler roll 26 contacts the fountain roll 12. At this first contact, the surface 20 of the fountain roll 12 is moving very slowly and the surface 34 of the idler roll 26 is moving relatively faster because the ductor assembly 25 is being rotated by the motor 82. Because the idler roll 26 is free to rotate about its axis 98, the contact of the faster moving surface 34 of the idler roll 26 with the slower moving surface 20 of the fountain roll 12 starts the idler roll 26 rotating about its axis 98. The idler roll 26 rotates about its axis with a rotational surface speed about equal to the speed of rotation of the ductor assembly 25. The first idler roll 26 rotates about its axis 98 in the direction indicated by the arrow 124, that is, opposite to the direction of rotation 122 of the ductor assembly 25.

The first idler roll 26 is normally in driving engagement with the second idler roll 28, although it is contemplated that the engagement may be intermittent. Thus, when the first idler roll 26 starts to rotate in the direction indicated by the arrow 124, the second idler roll 28 starts to rotate about its axis 100 in the direction of rotation indicated by the arrow 126. The second idler roll 28 thus rotates in the same direction as the ductor assembly 25. Ink is transferred from the first idler roll 26 to the second idler roll 28.

Figure 4:
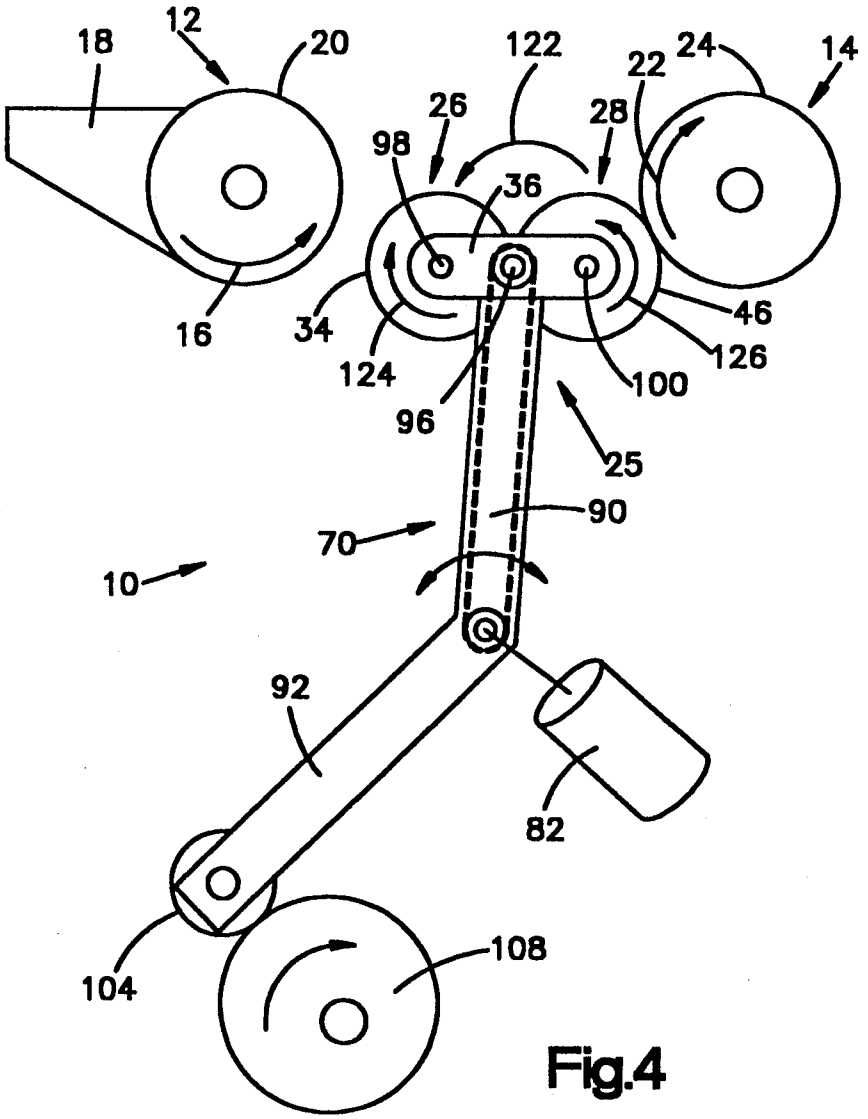
FIG. 4 is a schematic illustration with the ductor assembly in a position in contact with the ink receiving roll.

The cam 108 continues to rotate and causes the pivot arm 70 to pivot and move the ductor assembly 25 to the second position shown in FIG. 4. The second idler roll 28 contacts the ink receiving roll 14. At this contact, the surface 24 of the ink receiving roll 14 is moving rapidly in the direction of arrow 22. The surface 46 of the second idler roll 28 is moving in the same direction as the surface 24 of the ink receiving roll 14, both because the idler roll 28 is rotating in the direction of the arrow 126 and because the carriage 36 is rotating in the direction of the arrow 122. The surface 46 of the second idler roll 28 is moving in the direction of the arrow 126 with an overall surface speed which includes a speed component imparted by the rotation of the ductor assembly 25 about its axis 96 and a speed component imparted by the rotation of the second idler roll 28 about its axis 100. These two speed components are in the same direction when the roll 28 is in the position shown in FIG. 4 and are thus additive. The overall surface speed of the second idler roll 28 is therefore significantly greater than the surface speed of the fountain roll 12. Thus, as compared to a roll which rotates at the speed of the fountain roll, there is a closer match between the surface speeds of the second idler roll 28 and the ink receiving roll 14.

The ductor assembly 25 is preferably rotated at a speed which is one-half the difference between the surface speed of the fountain roll 12 and the surface speed of the ink receiving roll 14. For example, if the fountain roll 12 rotates with a surface speed of less than ten feet per minute, and if the ink receiving roll 14 rotates with a surface speed of about 3,000 feet per minute, then the ductor assembly 25 is preferably rotated at a speed which imparts to the first and second idler rolls a surface speed component of about 1,500 feet per minute. In this case, when the ductor assembly 25 contacts the fountain roll 12 (FIG. 1), the first idler roll 26 which contacts the fountain roll 12 will start to rotate in the direction of arrow 124 with a surface speed of about 1,500 feet per minute. Consequently, the second idler roll 28, which drivingly engages the first idler roll 26, will start to rotate in the direction of arrow 126 also with a surface speed of about 1,500 feet per minute. When the pivot arm 70 then moves the ductor assembly 25 to contact the ink receiving roll 14 (FIG. 4), the second idler roll 28 will have an overall surface speed equal to the speed component of about 1,500 feet per minute which is imparted by the rotation of the ductor assembly 25 in the direction of arrow 122, plus the speed component of about 1,500 feet per minute which results from the rotation of the second idler roll 28 about its axis 100 in the direction of arrow 126. These two speed components are in the same direction and thus the second idler roll 28 will rotate with an overall surface speed of about 3,000 feet per minute. Since the ink receiving roll 14 is also rotating with a surface speed of about 3,000 feet per minute, the speed mismatch between the two rolls is minimal.

Similarly, there is little speed mismatch when the first idler roll 26 moves back to contact the fountain roll 12 again (FIG. 1). The idler roll surface 34 which contacts the fountain roll 12 is being moved relative to the fountain roll 12 in one direction by the rotation of the ductor assembly 25 with a surface speed component of about 1,500 feet per minute, and in the opposite direction by the rotation of the idler roll 26 about its axis 98 with a surface speed component of about 1,500 feet per minute. Accordingly, the surface 34 of the first idler roll 26 which contacts the fountain roll 12 has an overall effective surface speed of about zero feet per minute. This is close to the surface speed of about less than ten feet per minute of the fountain roll 12, and the speed mismatch between the two rolls 12 and 26 is minimal.

Throughout the entire operation, the idler rolls 26 and 28 are caused to rotate about their axes of rotation 98 and 100 solely by contact of the rotating ductor assembly 25 with the rolls 12 and 14. It should therefore be noted that the foregoing description assumed that when the printing press was started, the ductor assembly 25 was first moved through contact with the fountain roll 12. If, however, the ductor assembly 25 is first moved into contact with the ink receiving roll 14, then the contact between the faster moving surface 24 of the ink receiving roll 14 and the slower moving surface of the nonrotating second idler roll 28 initially causes the second idler roll 28 to begin rotating about its axis 100 in the direction indicated by the arrow 146. The second idler roll 28 drives the first idler roll to begin to rotate about its axis 100 in the direction indicated by the arrow 124. The ductor assembly would then move over to contact the fountain roll 12. Of course, the idler rolls 26 and 28 may not necessarily be brought up to full speed of rotation about their axes 98 and 100 after only one contact with the fountain roll 12 or the ink receiving roll 14. More cycles of contact may be needed before the idler rolls 26 and 28 are brought up to speed.

A second embodiment of the invention is illustrated in FIGS. 6 through 9. In the second embodiment of the invention, the rotating ductor assembly, as in the first embodiment, travels back and forth between the ink supply roll 12 and the ink receiving roll 14. However, rather than being mounted on a pivot arm, the ductor assembly is rotatably mounted on the end of an orbit arm 132 and travels in a generally circular path between the ink supply roll 12 and the ink receiving roll 14. In the following description of the second embodiment of the invention, parts which are the same as in the first embodiment are identified with the same reference numerals.

The ductor assembly 25 (FIG. 6) includes a carriage 36 and first and second idler rolls 26 and 28. The ductor assembly 25 is rotatably mounted on the outer end 130 of an axis 96 on the orbit arm 132. The inner end 134 of the orbit arm 132 is journalled for rotation about a fixed axis 136. The axis 136 is located on an imaginary line 137 extending between the centers of rotation of the ink supply roll 12 and the ink receiving roll 14. The axis 136 is equidistant between the facing radially outer surfaces of the ink supply roll 12 and the ink receiving roll 14.

A carriage motor 82 drives a belt 76 to cause the ductor assembly 25 to rotate about its axis 96 on the orbit arm 132, in the direction indicated by the arrow 122. The direction of rotation 122 of the ductor assembly 25 is opposite to the direction of rotation 124 of the first idler roll 26, and is the same as the direction of rotation 126 of the second idler roll 28. A suitable drive mechanism such as an electric motor 138 effects orbiting movement of the orbit arm 132 about the axis 136 as shown schematically in the Figures, in the direction indicated by the arrow 140. The orbit arm 132 continuously rotates the ductor assembly 25 in a circular path from its first position adjacent the ink supply roll 12 (FIG. 7), to its second position adjacent the ink receiving roll 14 (FIG. 9), then back to the ink supply roll 12.

Figure 7:
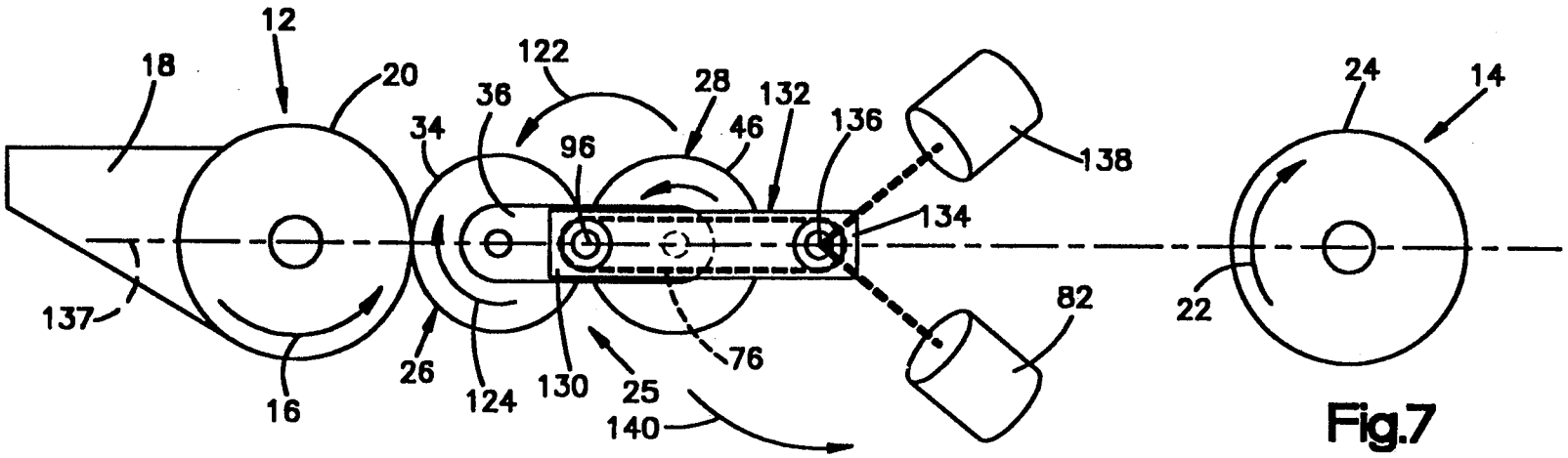
FIGS. 7 through 9 are schematic illustrations similar to FIG. 6 showing parts in different positions.
Figure 8:
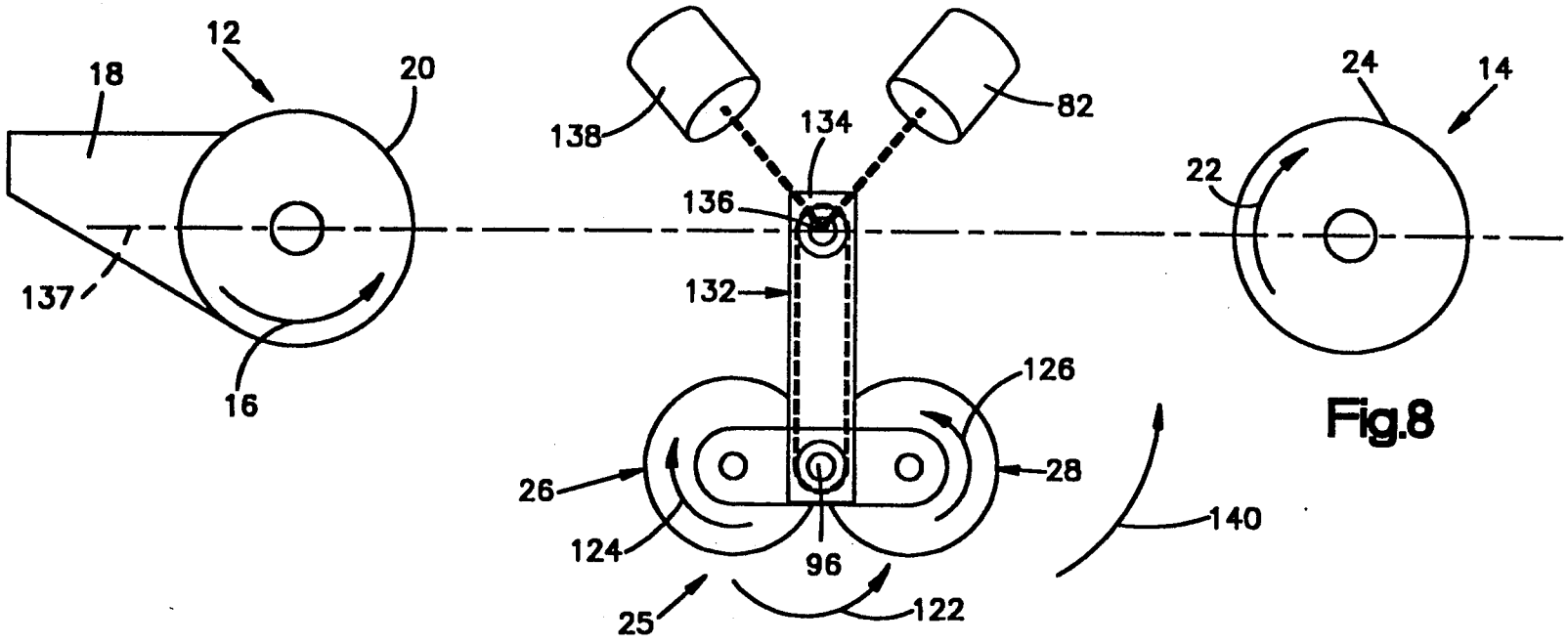

The speed of rotation of the ductor assembly 25 about its axis 96 is controlled so that the net effective surface speed of the first idler roll 26 is approximately equal to and is in the same direction as the surface speed of the ink supply roll 12. As in the first embodiment of the invention, the rotation of the ductor assembly 25 about its axis 96 is timed so that when the orbit arm 132 brings the ductor assembly 25 into location adjacent the ink supply roll 12, the first idler roll 26 contacts the ink supply roll 12 (FIG. 7). When the first idler roll 26 contacts the ink supply roll 12, the net effective surface speed of the surface 34 of the first idler roll 26 is approximately equal to and is in the same direction as the slow surface speed of the ink supply roll 12. Thus, as compared to a roll which rotates at the speed of the ink receiving roll 14, there is a closer match between the surface speeds of the first idler roll 26 and the ink supply roll 12.

Figure 9:
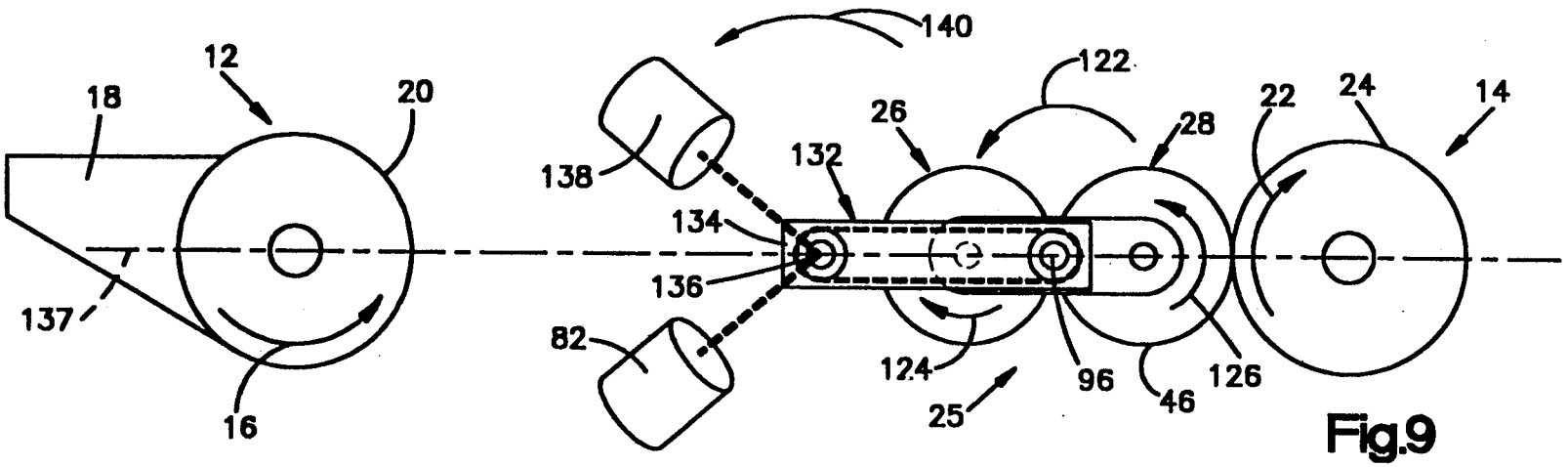

The speed of rotation of the ductor assembly 25 about its axis 96 is controlled so that the net effective surface speed of the second idler roll 28 is approximately equal to and is in the same direction as the surface speed of the ink receiving roll 14. The rotation of the ductor assembly 25 about its axis 96 is timed so that when the orbit arm 132 brings the ductor assembly 25 into location adjacent the ink receiving roll 14, the second idler roll 28 contacts the ink receiving roll 14 (FIG. 9). Thus, when the second idler roll 28 contacts the ink receiving roll 14, the net effective surface speed of the surface 46 of the second idler roll 28 is approximately equal to and is in the same direction as the surface speed of the ink receiving roll 14. Therefore, as compared to a roll which rotates at the speed of the ink supply roll 12, there is a closer match between the surface speed of the second idler roll 28 and the ink receiving roll 14.

A third embodiment of the invention is illustrated in FIGS. 10–13. In the third embodiment of the invention, the ductor assembly rotates about an axis which is fixed in position relative to the fountain roll, while an ink receiving roll moves into and out of contact with the ductor assembly. In the following description of the third embodiment of the invention, parts which are the same as in the first or second embodiments are identified with the same reference numerals.

The ductor assembly 150 (FIG. 10) includes a carriage 160, an idler roll 162, and a driven roll 164. The carriage 160 rotates in a direction 170 about an axis 172. The idler roll 162 is rotatable relative to the carriage 160 in a direction 166. The driven roll 164 is at least at times in driving engagement with the idler roll 162, and is rotatable in the carriage 160 in a direction 168. Thus, the ductor assembly 150 as a whole rotates about the axis 172 in the direction 170, while the idler roll 162 and the driven roll 164 each rotate about their own axes within the ductor assembly 150.

Figure 13:
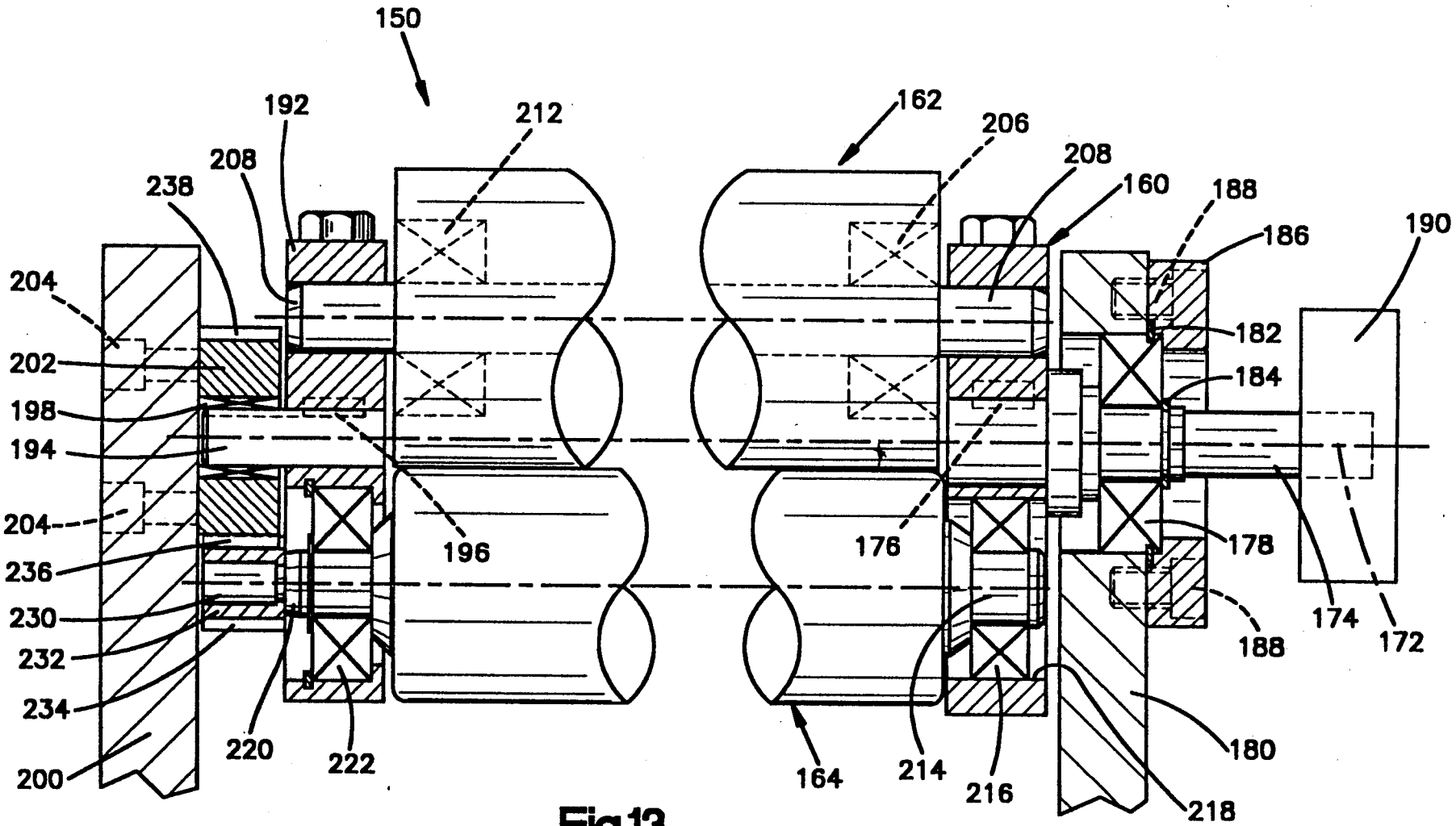
FIG. 13 is a view, partly in section, showing the axial ends of the ductor assembly of FIG. 10.

The ductor assembly 150 is illustrated in more detail in FIG. 13. The carriage 160 is fixed for rotation with a shaft 174 by a key 176. The shaft 174 is journalled in a bearing 178 in a frame member 180 of the printing press. The bearing 178 is secured in the frame member 180 by retaining rings 182 and 184 and a bearing cap 186. The bearing cap 186 is secured to the frame member 180 by fasteners 188. A drive sprocket 190 is fixed on the shaft 174.

At the opposite end of the ductor assembly 150, to the left as viewed in FIG. 13, an opposite end portion 192 of the carriage 160 is fixed for rotation with a shaft 194 by a key 196. The shaft 194 rotates in a bearing 198. The bearing 198 is located within a stationary gear 202 which is fixed to a frame member 200 of the printing press by fasteners 204. The central axis 172 of the ductor assembly 150 is also the central axis of the stationary gear 202.

The idler roll 162 at one end is journalled on a bearing 206 for rotation about a shaft 208. The shaft 208 is fixed to the carriage 160. At its opposite end, the idler roll 162 is journalled on a bearing 212 for rotation about the shaft 208 which is also fixed to the opposite end portion 192 of the carriage 160.

The driven roll 164 at one end has a roll end 214 journalled for rotation in a bearing 216. The bearing 216 is secured in an opening 218 in the carriage 160. At its opposite end, the driven roll 164 has a roll end 220 journalled for rotation in a bearing 222 fixed in the opposite end portion 192 of the carriage 160. The driven roll 164 is normally in driving engagement with the idler roll 162, so that the driven roll 164 and the idler roll 162 rotate in opposite directions about their own axes.

A motor and drive belt mechanism (not shown) like the motor and drive belt mechanism shown in FIGS. 1–9, drives the sprocket 190, turning the shaft 174 about the axis 172. The shaft 174 rotates the carriage 160 about the axis 172. The idler roll 162 and driven roll 164 both revolve about the central axis 172 of the ductor assembly 150 as the ductor assembly 150 rotates. As the idler roll 162 revolves around the axis 172, its outer surface 270 (FIG. 11) defines an imaginary cylindrical surface 272 which is the boundary of the volume of space which the ductor assembly travels through as it rotates about the axis 172. The driven roll 164 is smaller in diameter than the idler roll 162, and its outer surface always lies inside the imaginary surface 272.

The roll end 220 (FIG. 13) of the driven roll 164 has an extension 230. A movable gear 232 is fixed to the extension 230. The movable gear 232 has gear teeth 234 formed on its exterior surface. The external gear teeth 234 mesh as shown at 236 with external gear teeth 238 formed on the stationary gear 202. As the ductor assembly 150 rotates, the movable gear 232 revolves around the stationary gear 202. Because the gear teeth 234 on the movable gear 232 mesh with the gear teeth 238 on the stationary gear 202, the driven roll 164 is driven to rotate around its own axis. The driven roll 164 rotates around its own axis in the same direction as the ductor assembly 150 rotates around the central axis 210. Because the driven roll 164 is in driving engagement with the idler roll 162, the idler roll 162 is caused to rotate about the shaft 208 in the opposite direction as the driven roll 164.

In the embodiment of FIGS. 10–13, the ink receiving roll 152 is supported on a pivot arm 252. The pivot arm 252 is supported by a shaft 254 on a frame member (not shown) of the press. The pivot arm 252 includes a first arm portion 256 and a second arm portion 258. The second arm portion 258 has near its outboard end a shaft 260 on which a cam follower 262 rotates. The cam follower 262 rides on an outer surface 264 of a cam 266. The cam 266 is driven to rotate eccentrically about an axis 268.

As the cam 266 rotates about its eccentric axis of rotation 268, the cam follower 262 moves toward and away from the cam axis 268. As the cam follower 262 moves, the pivot arm portion 258 moves, pivoting the entire pivot arm 252 about the shaft 254. This pivotal movement of the pivot arm 252 moves the ink receiving roll 152 between a first position (FIG. 10) in which the ink receiving roll 152 does not contact the ductor assembly 150, and a second position (FIG. 12) in which the ink receiving roll 152 can contact the ductor assembly 150.

The ink receiving roll 152 is mounted on the pivot arm 252 in such a manner that the ink receiving roll 152, as it moves between the first and second positions, rolls along the surface of the distributor roll 154, always staying in contact with the distributor roll 154. The ink receiving roll 152 is driven to rotate about the shaft 250 through contact with the distributor roll 154 which is driven by the press. The ink receiving roll 152 rotates at a relatively high speed, for example, with a surface speed of about 3,000 feet per minute.

In order to pick up ink, the idler roll 162 contacts the fountain roll 12 once during each rotation of the ductor assembly 150. The surface 270 (FIG. 11) of the idler roll 162 contacts the outer surface 20 of the fountain roll 12. Ink is transferred from the fountain roll 12 to the idler roll 162. Because the idler roll 162 is in driving engagement with the driven roll 164, ink from the fountain roll 12 is also transferred from the idler roll 162 to the driven roll 164.

The ink receiving roll 152 is then moved inside the imaginary boundary surface 272, by the pivot arm 252. The ink receiving roll 152 moves inside the imaginary surface 272 before the driven roll 164 comes around into contact with the receiving roll 152. The ink receiving roll 152 is in a relatively fixed position when the driven roll 164 comes around into contact (FIG. 12) with the ink receiving roll 152. The ink receiving roll 152 picks up ink from the driven roll 164 and transfers the ink to the distributor roll 154 and thence via the roll 156 to the remaining portion of the press.

Figure 10:
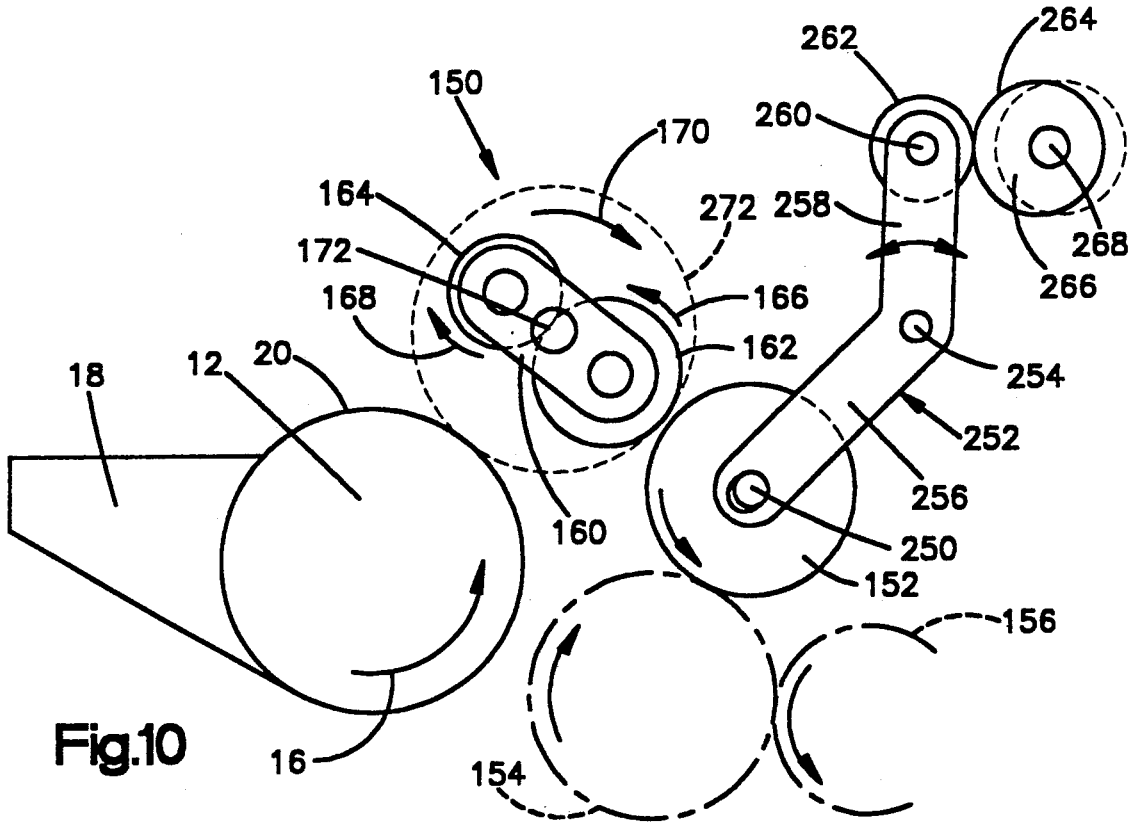
FIG. 10 is a schematic illustration of a portion of a printing press including a ductor assembly in accordance with a third embodiment of the invention.
Figure 11:
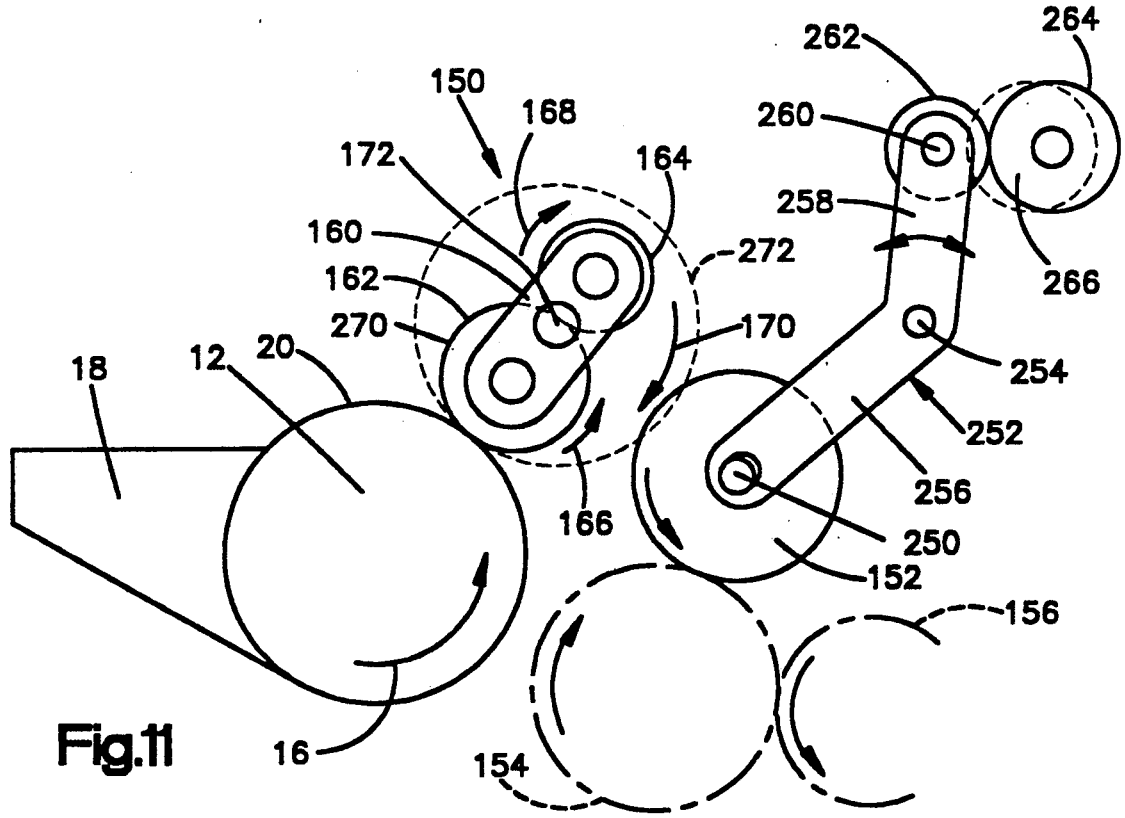
FIGS. 11 and 12 are schematic illustrations similar to FIG. 10 showing parts in different positions.
Figure 12:
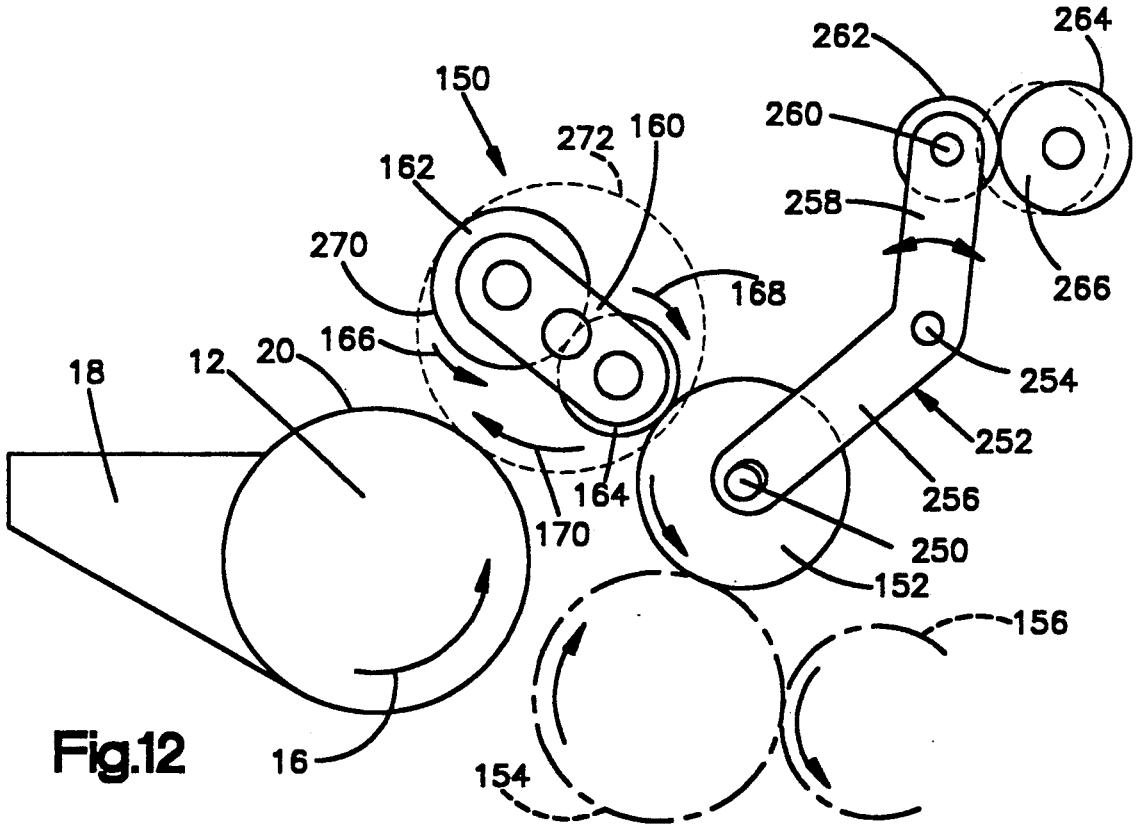

The ink receiving roll 152 and the ductor assembly 150 are positioned so that the idler roll 162 can not contact the ink receiving roll 152. As seen in FIG. 10, when the idler roll 162 is in a position closest to the ink receiving roll 152, there is a gap 276 between the idler roll 162 and the ink receiving roll 152. Thus, the ink receiving roll can not contact the idler roll 162, but can only contact the driven roll 164 upon being moved within the boundary 272 by the pivot arm 252.

The speeds of rotation of the ductor assembly 150, the idler roll 162, and the driven roll 164 are selected so as to minimize speed mismatch when the idler roll 162 contacts the fountain roll 12, and to minimize speed mismatch when the driven roll 164 contacts the ink receiving roll 152. The ductor assembly 150 is rotated in the direction 170 at a speed which is intermediate the slower surface speed of the fountain roll 12 and the faster surface speed of the ink receiving roll 152. This rotation of the ductor assembly about its axis of rotation 172 imparts to the surfaces of the idler roll 162 and the driven roll 164 a surface speed component which is intermediate the first and second surface speeds. The driven roll 164 rotates about its axis in the same direction of rotation as the rotation of the ductor assembly 150 about its axis 172. The number and spacing of the gear teeth on the movable gear 232 and on the stationary gear 202 are chosen so that the rotation of the driven roll 164 about its axis imparts to the surface of the driven roll 164 a surface speed component which is the same as the surface speed component imparted by the net rotation of the ductor assembly 150 as a whole. Because the driven roll 164 is in driving engagement with the idler roll 162, the idler roll 162 rotates in the opposite direction as indicated by the arrow 166, with an equivalent surface speed.

The ductor assembly 150 is preferably rotated at a speed which is one-half the difference between the surface speed of the fountain roll 12 and the surface speed of the ink receiving roll 152. For example, if the fountain roll 12 rotates with a surface speed of about less than 10 feet per minute, and if the ink receiving roll 152 rotates with a surface speed of about 3,000 feet per minute, then the ductor assembly is preferably rotated at a speed which imparts to the idler roll 162 and driven roll 164 a surface speed component of about 1,500 feet per minute.

When the ink receiving roll 152 contacts the driven roll 164 (FIG. 12), the driven roll 164 has an overall surface speed equal to the speed component of about 1,500 feet per minute which is imparted by the rotation of the ductor assembly 150 in the direction of arrow 170, plus the speed component of about 1,500 feet per minute which results from the rotation of the driven roll 164 about its axis in the direction of arrow 168. These two speed components are in the same direction and thus the driven roll 164 rotates with an overall surface speed of about 3,000 feet per minute. Since the ink receiving roll 152 is also rotating with a surface speed of about 3,000 feet per minute, the speed mismatch between the two rolls is minimal.

Similarly, there is little speed mismatch when the idler roll 162 contacts the fountain roll 12. The idler roll surface 270 (FIG. 11) which contacts the fountain roll 12 is being moved relative to the fountain roll 12 in one direction by the rotation of the ductor assembly 150 in the direction 168 with a surface speed component of about 1,500 feet per minute, and in the opposite direction by the rotation of the idler roll 162 about its axis in the direction 166 with a surface speed component of about 1,500 feet per minute. Accordingly, the surface 270 of the idler roll 162 which contacts the surface 20 of the fountain roll 12 has an overall effective surface speed of about zero feet per minute. This is close to the surface speed of about less than 10 feet per minute of the fountain roll 12, and the speed mismatch between the two rolls is minimal.

From the above description of the invention, those skilled in the art will perceive improvements, changes and modifications. Such improvements, changes and modifications within the skill of the art are intended to be covered by the appended claims.

Having described the invention, the following is claimed:

1. Apparatus comprising:

an ink supply roll having an outer surface rotatable at a first surface speed, and means for rotating said ink supply roll at said first surface speed;

an ink receiving member having an outer surface rotatable at a second surface speed which is substantially greater than said first surface speed, and means for rotating said ink receiving member at said second surface speed;

a ductor assembly comprising a first idler roll for contacting said ink receiving roll and a second idler roll for contacting said ink supply roll, said first and second idler rolls having a driving engagement and each having a central axis of rotation, and carriage means for supporting said first and second idler rolls for rotation about each of their respective central axes, said carriage means having an axis of rotation spaced apart from the central axes of said first and second rolls;

means for displacing said ink receiving roll between a first position in which said ink receiving roll does not contact said first idler roll and a second position in which said ink receiving roll contacts said first idler roll; and means for rotating said carriage means about its axis of rotation at a third speed intermediate said first and second surface speeds to cause said first idler roll to move at about said second surface speed when said ink receiving roll is in said second position.

2. Apparatus as defined in claim 1 further including means for rotating said first roll about its axis of rotation at about said third speed.

3. Apparatus as defined in claim 1 wherein said means for rotating said carriage means causes said second roll to move at about said first surface speed when said second roll contacts said ink supply roll.

4. Apparatus as defined in claim comprising means for rotating said first and second rolls about their respective central axes in opposite directions of rotation, and wherein said means for rotating said carriage means rotates said carriage means in the same direction of rotation as said first roll rotates about its own axis and in the opposite direction of rotation from the direction in which said second roll rotates about its own axis.

5. Apparatus as defined in claim 4 wherein said third speed is approximately one half of the difference between said first surface speed and said second surface speed.

6. Apparatus as defined in claim 1 wherein said means for displacing comprises a pivot arm supporting said ink receiving roll for rotation and means for pivoting said pivot arm to move said ink receiving roll between said first and second positions.

7. Apparatus as defined in claim 1 wherein said means for rotating said carriage means includes means for rotating said carriage means continuously while said ink receiving roll is moved between said first and second positions.

8. Apparatus as defined in claim 1 wherein said axis of rotation of said carriage means is fixed in position relative to said ink supply roll, and wherein the diameter of said first roll is less than the diameter of said second roll.

9. Apparatus as defined in claim 1 wherein said axis of rotation of said carriage means is fixed in position relative to said ink supply roll, said second roll continuously revolves about said axis of rotation of said carriage means, and said ink receiving roll enters into the path of movement of said second roll to contact said first roll.

10. Apparatus comprising:

an ink supply roll having an outer surface rotatable at a first surface speed, and means for rotating said ink supply roll at said first surface speed;

an ink receiving member having an outer surface rotatable at a second surface speed which is substantially greater than said first surface speed, and means for rotating said ink receiving member at said second surface speed;

a ductor assembly comprising a first idler roll for contacting said ink receiving roll and a second idler roll for contacting said ink supply roll, said first and second idler rolls having a driving engagement and each having a central axis of rotation, and carriage means for supporting said first and second idler rolls for rotation about each of their respective central axes, said carriage means having an axis of rotation spaced apart from the central axes of said first and second idler rolls;

means for displacing said ink receiving roll between a first position in which said ink receiving roll does not contact said first idler roll and a second position in which said ink receiving roll contacts said first idler roll; and means for rotating said carriage means about its axis of rotation at a third speed intermediate said first and second surface speeds to cause said first idler roll to move at about said second surface speed when said ink receiving roll is in said second position;

wherein said first and second idler rolls have different diameters, and said means for displacing moves said ink receiving roll into the path of revolution of said second idler roll to contact said first idler roll.

11. Apparatus comprising:

an ink supply roll having an outer surface rotatable at a first surface speed, and means for rotating said ink supply roll at said first surface speed;

an ink receiving member having an outer surface rotatable at a second surface speed which is substantially greater than said first surface speed, and means for rotating said ink receiving member at said second surface speed;

a ductor assembly comprising a first idler roll and a second idler roll each having a central axis of rotation, said first and second idler rolls being at least at times in driving engagement, and a carriage member having means for supporting said first and second idler rolls for rotation about each of their respective central axes with a first surface speed component in response to contact with said ink supply roll and said ink receiving member, said carriage member having an axis of rotation spaced apart from the central axes of said first and second idler rolls;

means for displacing one of said members between a first position in which said second idler roll is not in ink transferring relationship with said ink receiving member and a second position in which said second idler roll is in ink transferring relationship with said ink receiving member; and means for rotating said carriage member about its axis of rotation to impart to said second idler roll a second surface speed component intermediate said first and second surface speeds which combines with said first surface speed component of said second idler roll to cause said second idler roll to move at about said second surface speed when said one of said members is in said second position.

* * * * *

UNITED STATES PATENT AND TRADEMARK OFFICE

CERTIFICATE OF CORRECTION

PATENT NO. : 5,123,351

DATED : June 23, 1992

INVENTOR(S) : Glenn A. Guaraldi, David G. Addison and David C. Gibson

It is certified that error appears in the above-identified patent and that said Letters Patent is hereby corrected as shown below:

Column 11, line 40, claim 4, after "claim" insert --1--.

Signed and Sealed this

Twenty-first Day of September, 1993

Bruce Lehman

*Attest:*

BRUCE LEHMAN

*Attesting Officer*

*Commissioner of Patents and Trademarks*